US006958458B1

(12) United States Patent
Tsai

(10) Patent No.: US 6,958,458 B1
(45) Date of Patent: Oct. 25, 2005

(54) KEY SWITCH DEVICE HAVING HIGH DRAWABILITY

(76) Inventor: Huo-Lu Tsai, No. 188-1, Chung-Cheng Road, Shang-Feng Tsun, Ta-Ya Shiang, Taichung Hsien (TW)

( * ) Notice: Subject to any disclaimer, the term of this patent is extended or adjusted under 35 U.S.C. 154(b) by 0 days.

(21) Appl. No.: 10/944,763

(22) Filed: Sep. 21, 2004

(51) Int. Cl.[7] ..... H01H 13/705
(52) U.S. Cl. ..... 200/344
(58) Field of Search ..... 200/5 A, 517, 200/344, 345; 400/490, 491, 491.2, 495, 400/495.1, 496

(56) References Cited

U.S. PATENT DOCUMENTS 5,833,050 A * 11/1998 Takagi et al. ..... 200/344
6,172,868 B1 * 1/2001 Oura ..... 200/344
6,572,289 B2 * 6/2003 Lo et al. ..... 400/491.3
6,706,986 B2 * 3/2004 Hsu ..... 200/344

* cited by examiner

*Primary Examiner*—Michael A. Friedhofer
(74) *Attorney, Agent, or Firm*—Banner & Witcoff, Ltd.

(57) ABSTRACT

A key switch device has a cap support that supports a key cap on a base. The cap support includes intersecting first and second frames which are connected pivotally to each other. The first frame has a pair of through holes, whereas the second frame has a pair of retaining pins for connection with the through holes. Each retaining pin has an outermost head, an inner neck part and a shoulder formed between the outermost head and the inner neck part. The first and second frames are connected to each other by inserting each retaining pin into the corresponding through hole until the outermost head projects outwardly of the through hole and the shoulder engages an outer side of the first frame.

2 Claims, 11 Drawing Sheets

KEY SWITCH DEVICE HAVING HIGH DRAWABILITY

BACKGROUND OF THE INVENTION

1. Field of the Invention

This invention relates to a key switch device, more particularly to a key switch device for computers and other data processing devices.

2. Description of the Related Art

As shown in FIG. 1, a typical key switch device includes a base support composed of a substrate 1, a membrane circuit member 2 mounted on the substrate 1, a resilient layer 3 superimposed upon the membrane circuit member 2, and a plurality of key caps 5 (only one is shown for simplicity) each of which is mounted on the substrate 1 through a cap support 4.

Each cap support 4 includes two intersecting first and second frames 6 and 7 which are interconnected pivotally to each other. The first frame 6 has a substantially U-shape and includes two lateral rods 601 and an intermediate member 602 connected to the lateral rods 601. Each lateral rod 601 is provided with a retaining hole 603 at the middle thereof. The second frame 7 is a four-sided closed frame which includes two rods 701 interconnected by a mortised member 702 and a slide pin 703 interconnecting the rods 701 opposite to the mortised member 702. Two retaining pins 704 project outwardly and respectively from the rods 701. The key cap 5 includes a top wall 501, a pair of pivot retainers 502 and a pair of latch retainers 503 all of which project from the bottom side of the top wall 501, and two guide members 504. The pivot retainers 502 engage respectively two ends of the slide pin 703 of the second frame 7, whereas the latch retainers 503 engage respectively two pins 604 of the first frame 6. The guide members 504 serve to guide the first and second frames 6 and 7 so that they can be aligned properly with the key cap 5 upon assembly.

The aforesaid prior art suffers from a problem in that, when the key switch device is subjected to a drawability test, the first frame 6 is prone to stretch outward and deform, thus lowering the drawability of the key switch device. In addition, due to the increasing demand for the miniaturization of key switch devices, the use of the guide members 504 which take up substantial space of the key cap 5 is disadvantageous. Furthermore, the need to form the guide members 504 on the top wall 501 of the key cap 5 requires an additional molding material and can result in indentations in the key cap 5 due to shrinkage upon cooling of the molded product. Moreover, after assembly, the drawability of the pivot retainers 502 cannot be enhanced by providing the guide members 504.

SUMMARY OF THE INVENTION

An object of the present invention is to provide a key switch device with a strong structure for a cap support so that the connection between the cap support and a key cap can be strengthened and the drawability of the key switch can be enhanced.

Another object of the present invention is to provide a key cap having a guide member with a reduced size and simple structure to facilitate manufacturing of the key cap.

Accordingly, a key switch device according to the present invention comprises a base, a key cap, and a cap support mounted on the base and supporting the key cap, wherein the cap support includes: a first frame having a first top member connected to the key cap, a first bottom member connected to the base, a pair of spaced apart first lateral members interconnecting the first top and bottom members, and a pair of through holes respectively formed in the first lateral members, each of the through holes being tapered from an inner side to an outer side of a corresponding one of the first lateral members; and a second frame connected pivotally to the first frame and having a second top member connected to the key cap, a second bottom member connected to the base, a pair of spaced apart second lateral members interconnecting the second top and bottom members, and a pair of retaining pins projecting outwardly and respectively from the second lateral members. Each of the retaining pins has an outermost head, an inner neck part and a shoulder formed between the outermost head and the inner neck part. The retaining pins are respectively inserted into the through holes until the outermost heads of the retaining pins project outwardly and respectively from the through holes and until the shoulders of the retaining pins extend out respectively from said through holes.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
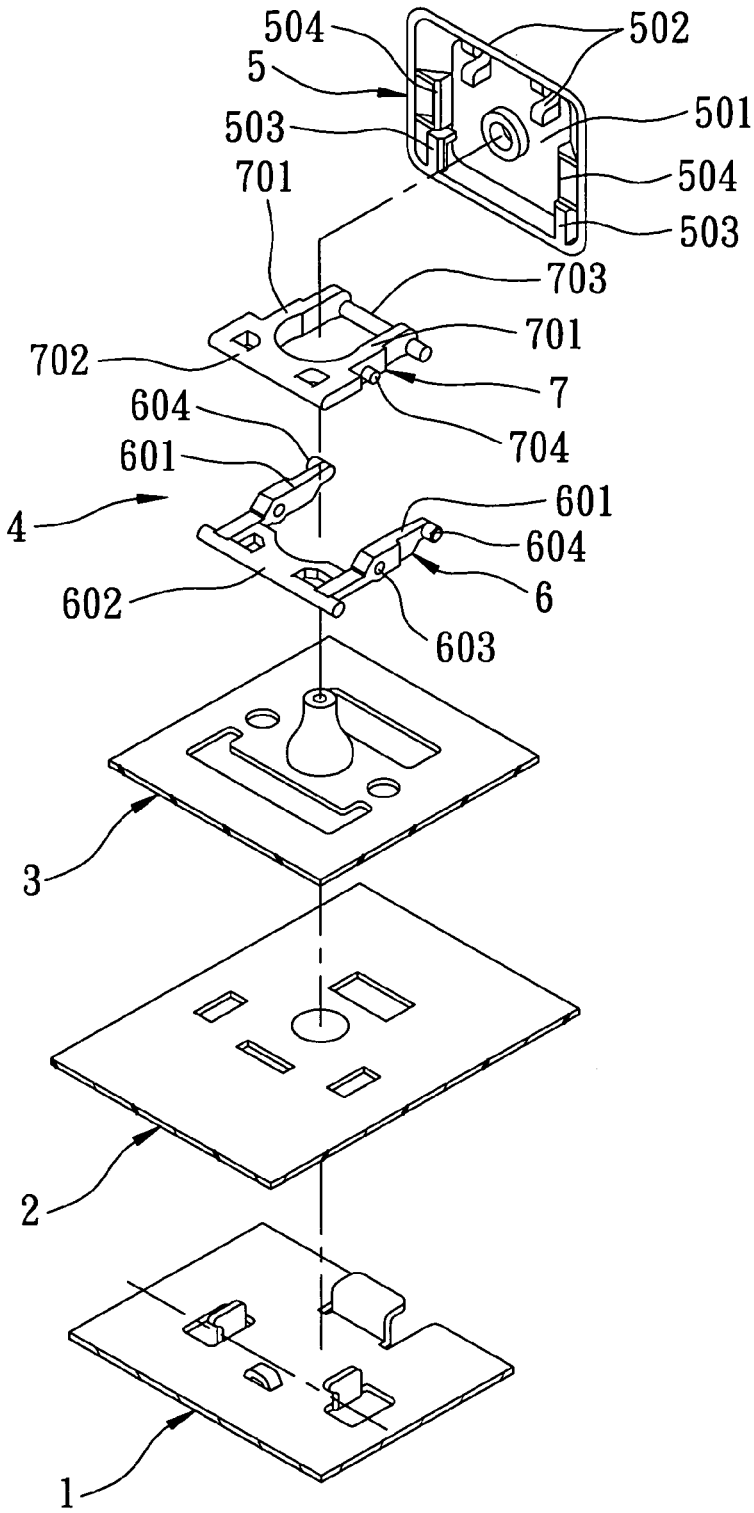
FIG. 1 PRIOR ART
FIG. 1 is an exploded view of the prior art.

Before the present invention is described in greater detail, it should be noted that same reference numerals have been used to denote like elements throughout the specification.

Figure 2:
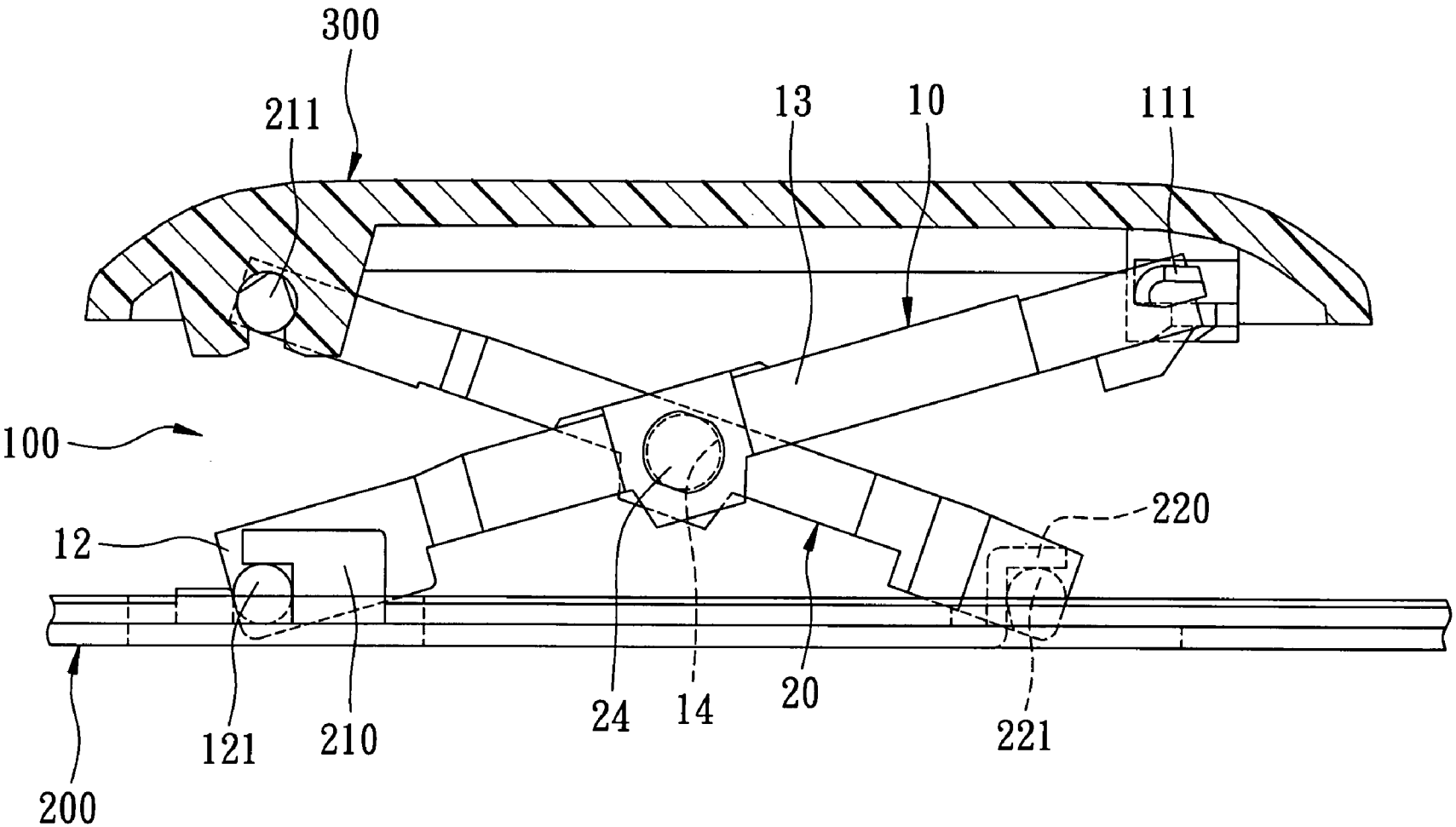
FIG. 2 is a sectional view of the first preferred embodiment according to the present invention.

Referring to FIG. 2, the first preferred embodiment of the key switch device according to the present invention includes a cap support 100 mounted on a base 200 and a key cap 300 supported by the cap support 100. The base 200 has first retention members 210 and second retention members 220 which project upward from the base 200. The cap support 100 includes two intersecting first and second frames 10 and 20 which are connected pivotally to each other and which are made of plastic by injection molding.

Figure 3:
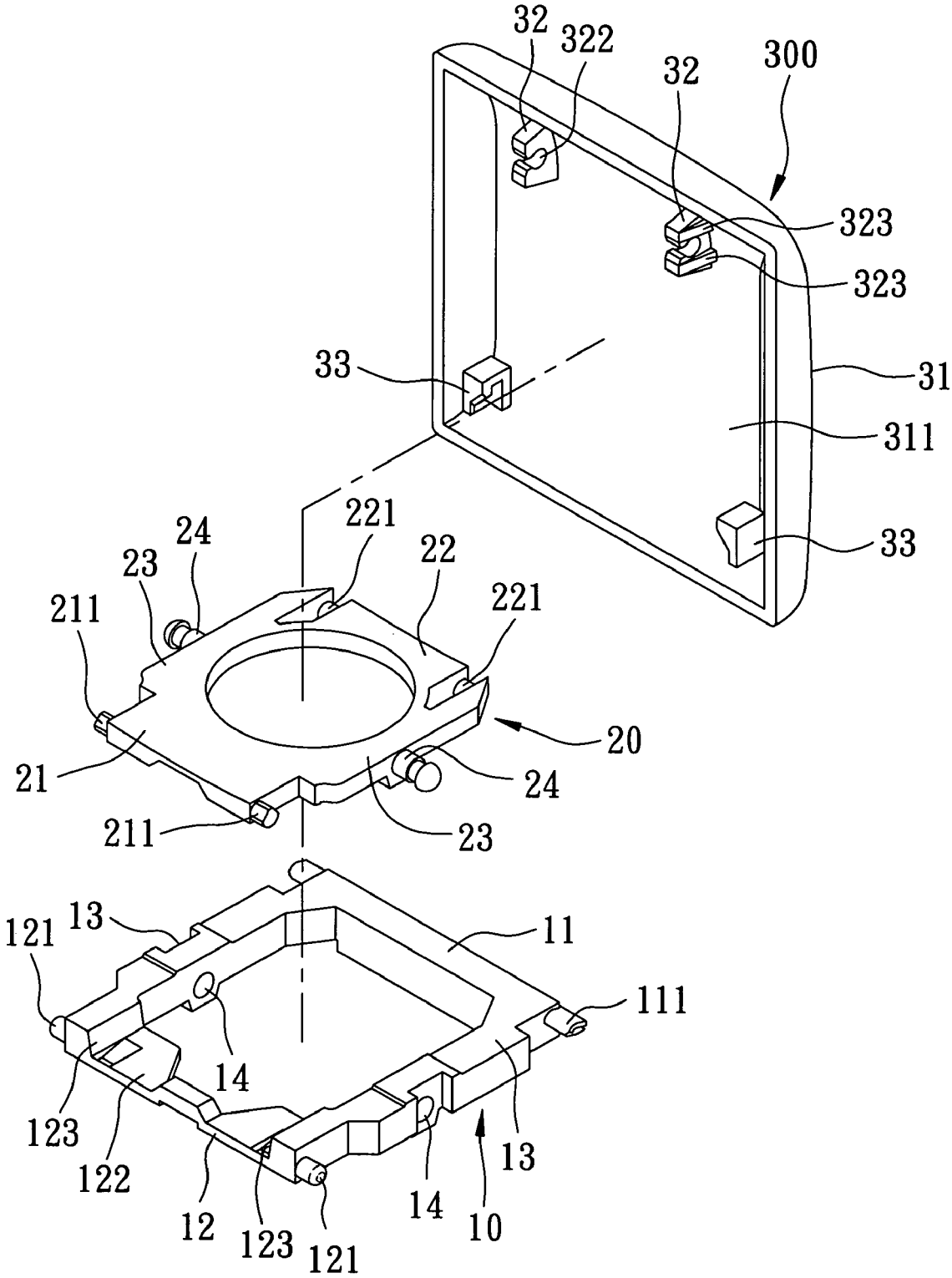
FIG. 3 is an exploded view of a cap support and a key cap of the first embodiment.
Figure 4:
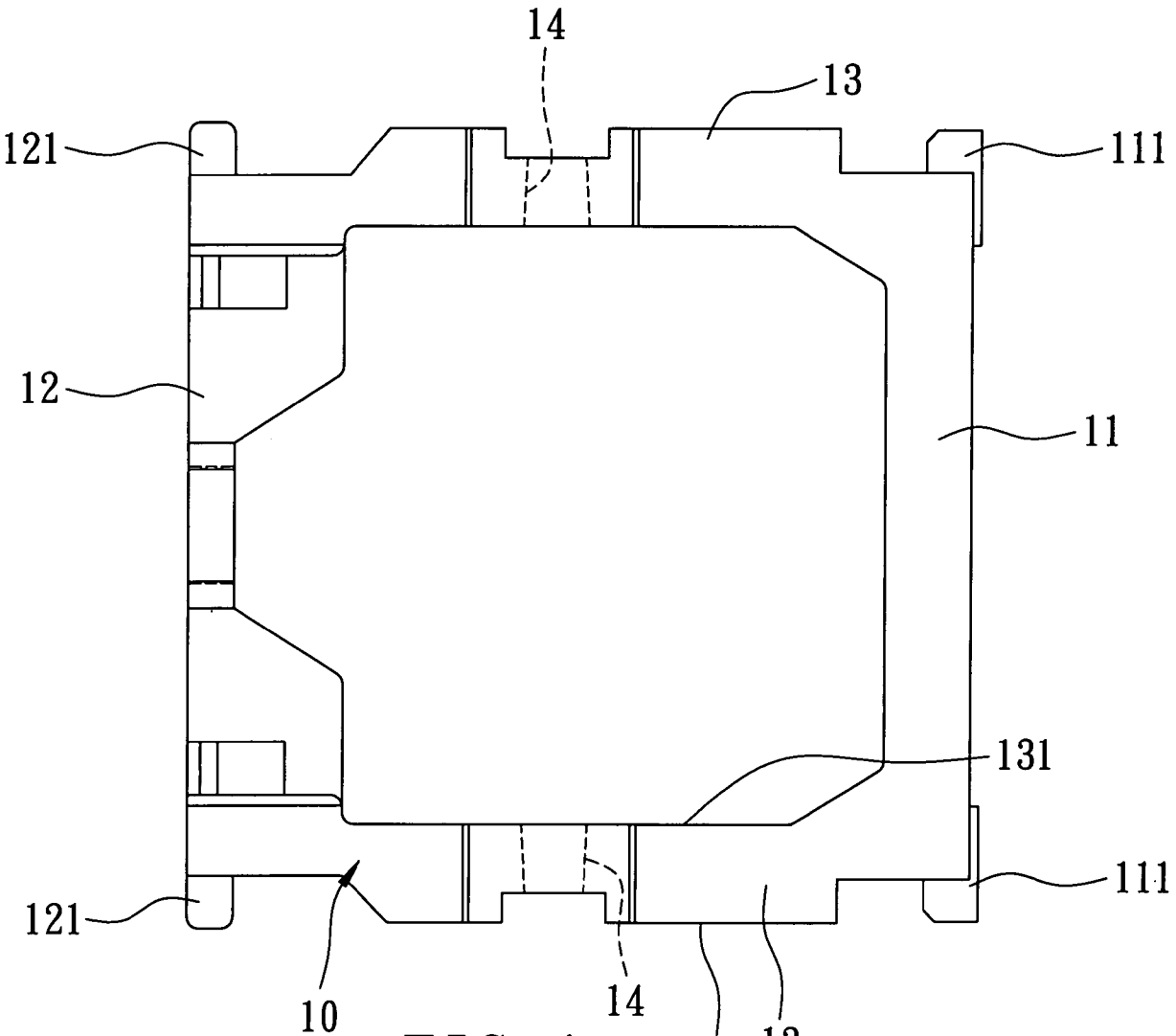
FIG. 4 is a plan view of a first frame of the cap support.

Referring to FIGS. 3 and 4, the first frame 10 is configured as a four-sided closed frame and includes a first top member 11, a first bottom member 12 and two spaced apart first lateral members 13 interconnecting the first top and bottom members 11 and 12. Latch pins 111 project outwardly and respectively from two ends of the first top member 11, whereas retention pins 121 project outwardly and respectively from the first bottom member 12. The retention pins 121 respectively engage the first retention members 210 of the base 200. Each first lateral member 13 is formed with a through hole 14 in an intermediate part thereof. The through hole 14 is tapered from an inner side 131 to an outer side 132 of the corresponding first lateral member 13.

Figure 5:
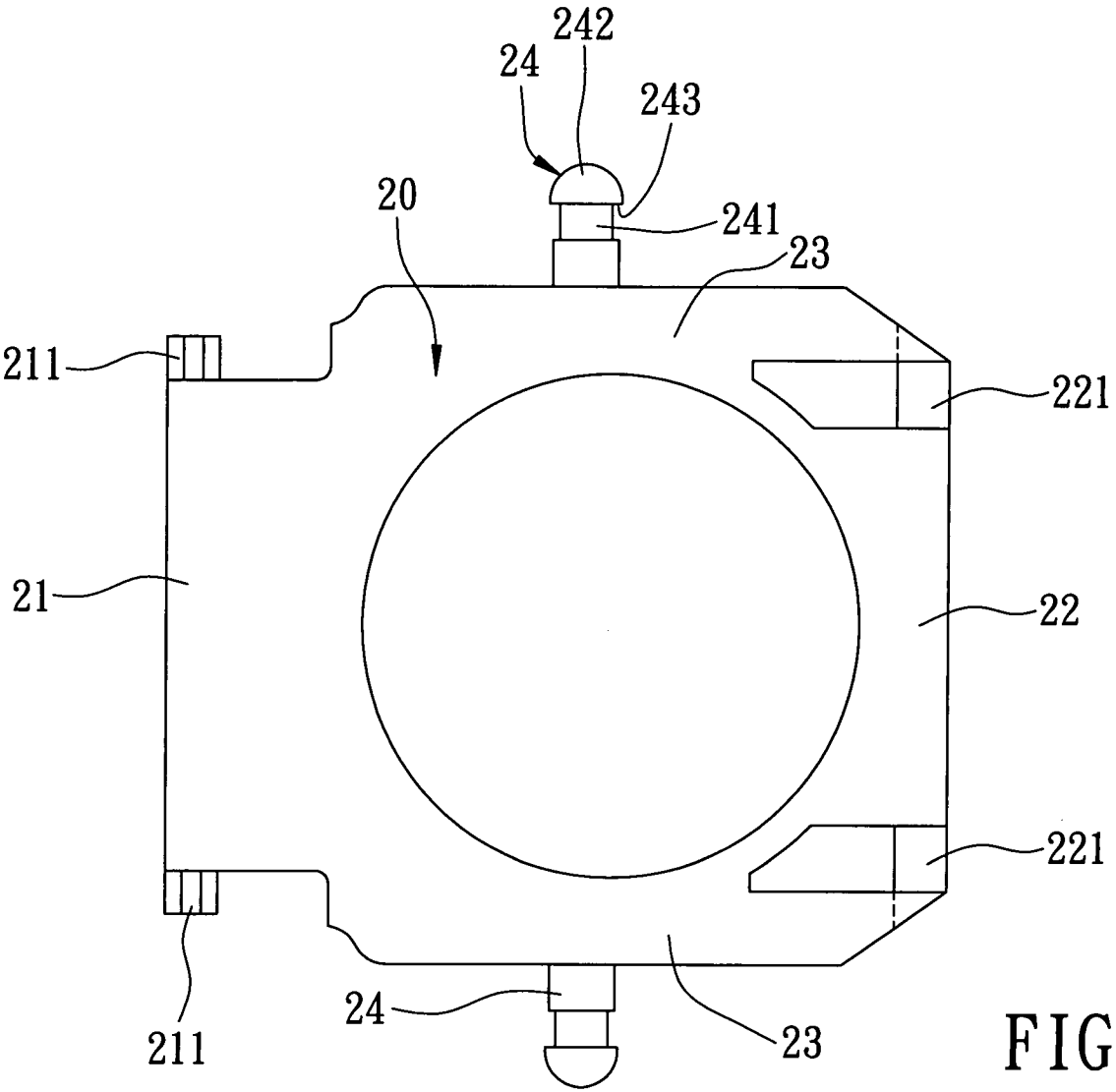
FIG. 5 is a plan view of a second frame of the cap support.

Referring to FIG. 5 in combination with FIG. 3, the second frame 20 is also configured as a four-sided closed frame and includes a second top member 21, a second bottom member 22, and a pair of spaced apart second lateral members 23 interconnecting the second top and bottom members 21 and 22. A pair of pivot pins 211 project outwardly and respectively from two ends of the second top member 21, whereas a pair of retention pieces 221 are formed in the second bottom member 22. The retention pieces 221 engage respectively the second retention members 220 of the base 200. Each second lateral member 23 is formed with a retaining pin 24 which projects outwardly from an intermediate part of the corresponding second lateral member 23. The retaining pin 24 has an outermost head 242, an inner neck part 241 and a shoulder 243 formed between the outermost head 242 and the inner neck part 241. In this embodiment, the outermost head 242 is formed as a hemispherical shape whose diameter is larger than that of the inner neck part 241 and that of the corresponding through hole 14.

Figure 6:
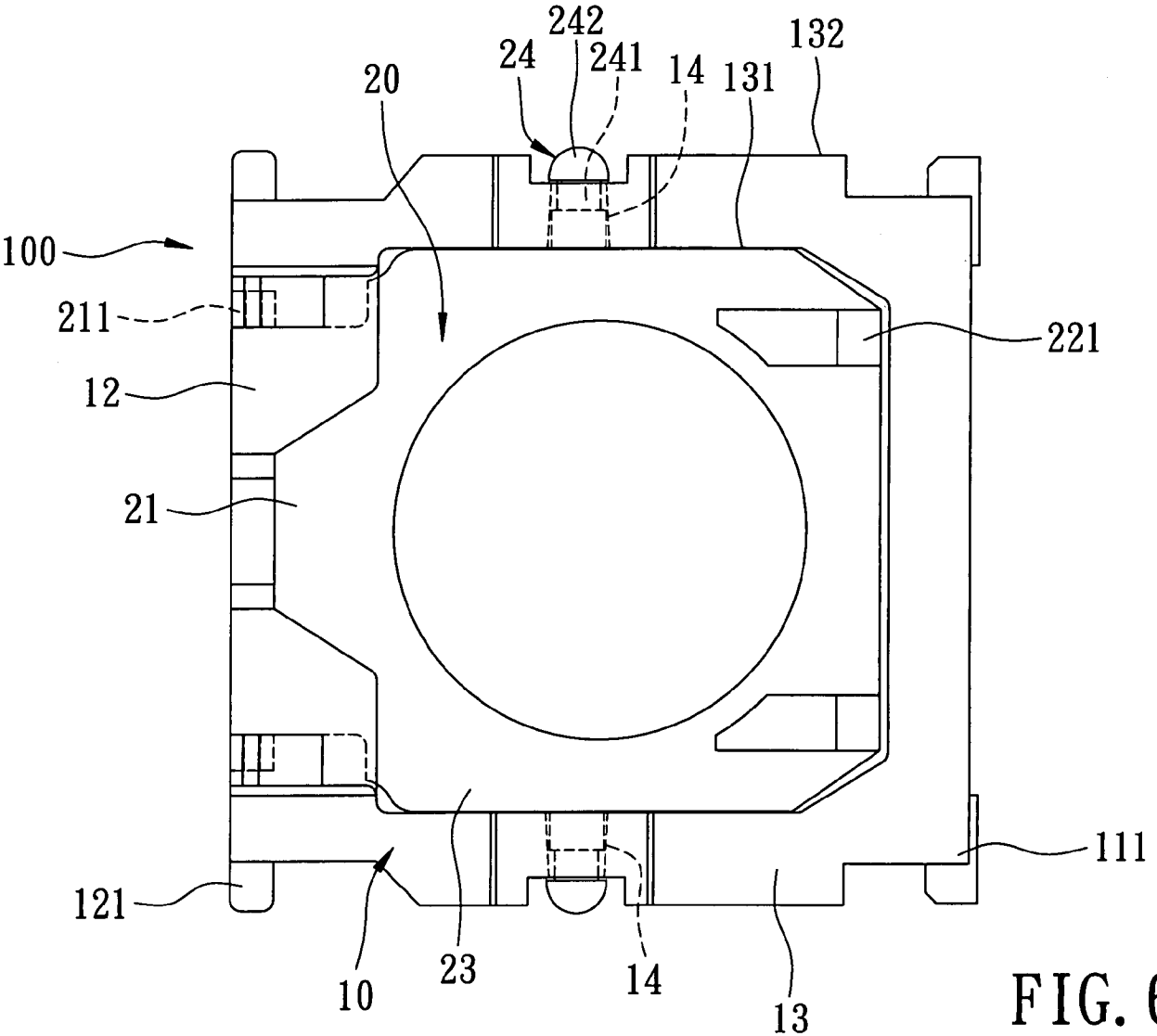
FIG. 6 is a plan view of the first and second frames which are connected together.

Referring to FIG. 6 in combination with FIGS. 2 and 3, the first frame 10 is connected to the second frame 20 by inserting the retaining pins 24 into the respective retaining holes 14 until the outermost heads 242 project outwardly from the respective retaining holes 14 and the shoulders 243 engage the respective outer sides 132 of the first lateral members 13. When the first and second top members 11 and 21 are moved respectively toward the second and first bottom members 22 and 12, the cap support 100 is placed in a collapsed state. Due to the larger diameter of each outermost head 242 and due to the engagement of each shoulder 243 with the outer side 132 of the corresponding first lateral member 13, each retaining pin 24 can be prevented from being released from the corresponding through hole 14, thereby strengthening the connection between the first and second frames 10 and 20.

Figure 7:
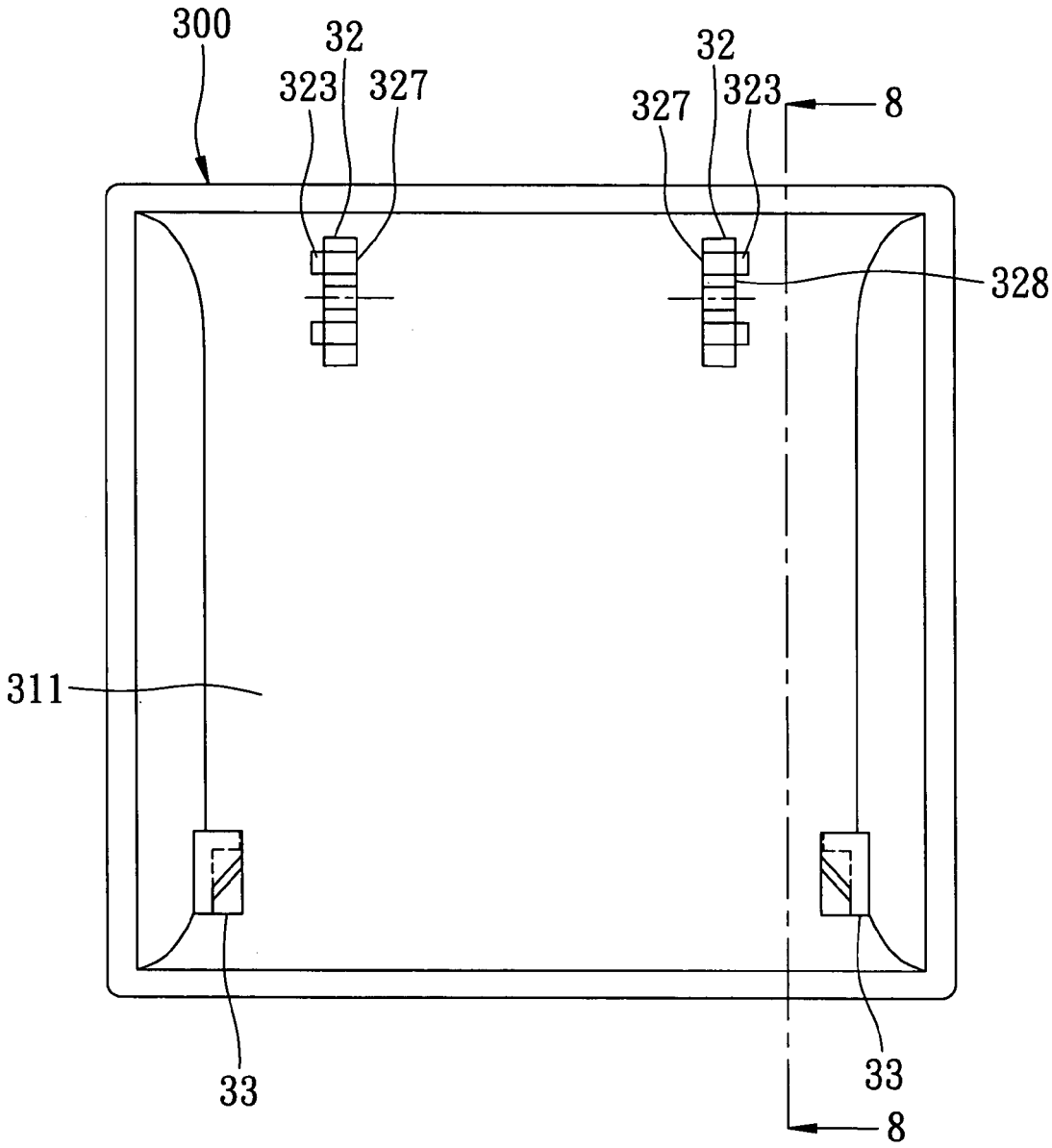
FIG. 7 is a bottom view of the key cap.
Figure 8:
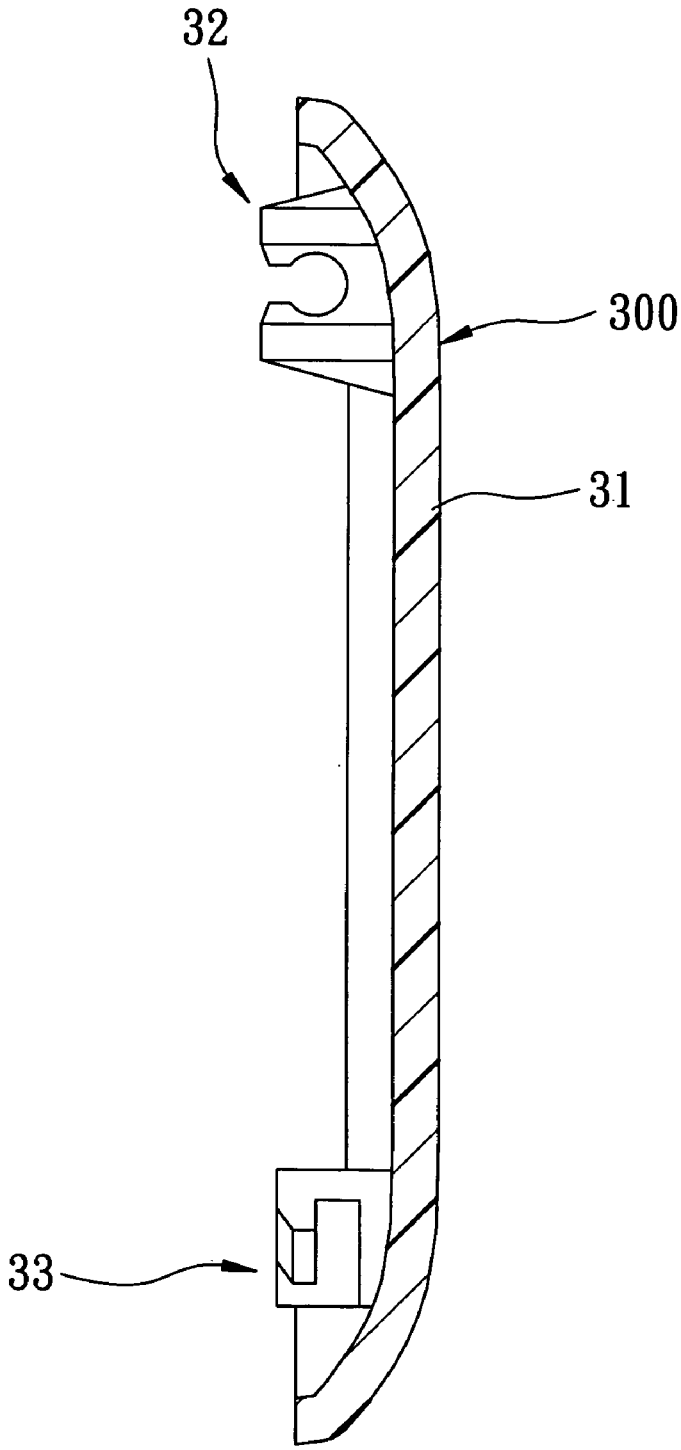
FIG. 8 is a sectional view taken along line 8—8 of FIG. 7.
Figure 9:
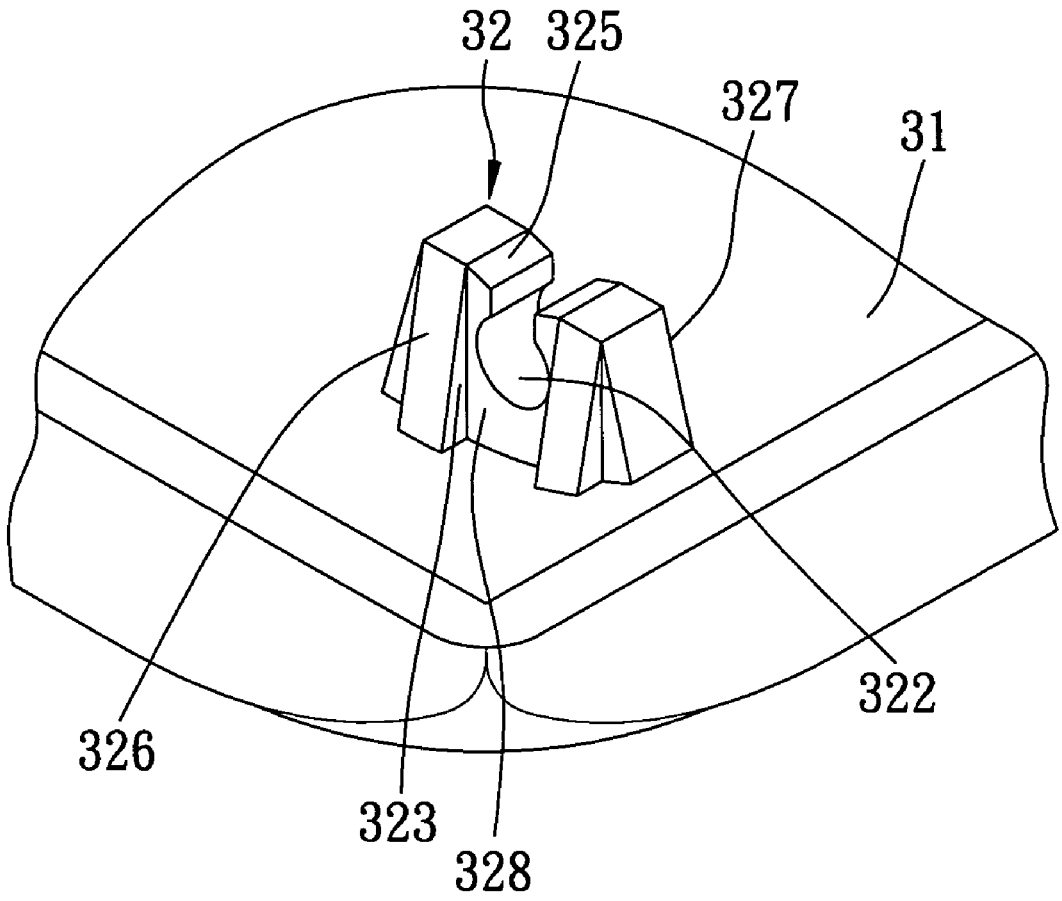
FIG. 9 is a fragmentary perspective view of the key cap.

Referring to FIGS. 7, 8 and 9 in combination with FIG. 3, the key cap 300 includes a top wall 31, a pair of pivot retainers 32 for connection with the pivot pins 211, and a pair of latch retainers 33 for connection with the latch pins 111. The pivot retainers 32 and the latch retainers 33 are formed on and project downward from a bottom side 311 of the top wall 31. Each pivot retainer 32 has a distal end 325 disposed away from the top wall 31, and two side faces, i.e. inner and outer side faces 327, 328, which extend between and connect with the top wall 31 and the distal end 325. The inner side faces 327 of the pivot retainers 32 face toward each other, and the outer side faces 328 thereof are respectively opposite to the inner side faces 327. Each pivot retainer 32 further has a pivot hole 322 that passes through the inner and outer side faces 327 and 328, and two guide ribs 323 which project outwardly from the outer side face 328 and which extends from the top wall 31 to the distal end 325. Each guide rib 323 is tapered from the top wall 31 to the distal end 325 and defines an inclined guide surface 326.

Figure 10:
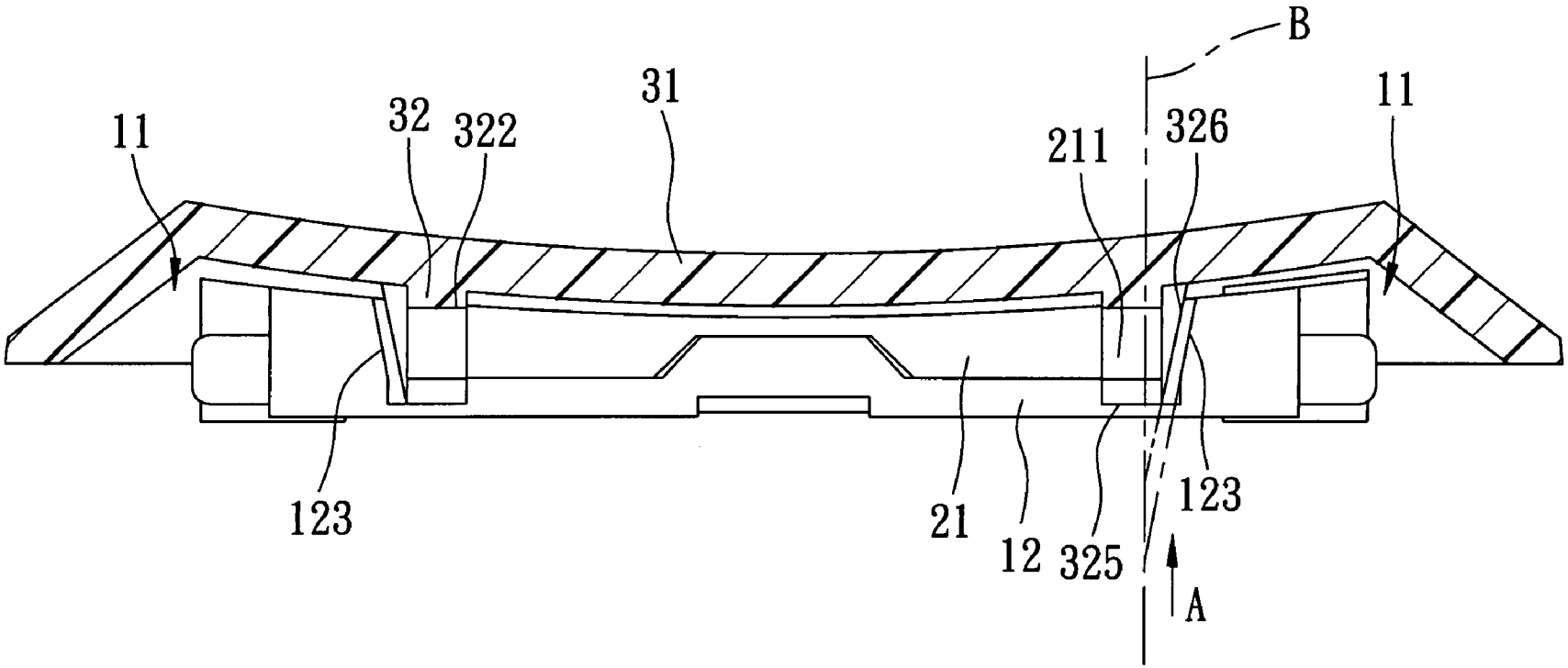
FIG. 10 is a sectional view of the cap support and the key cap which have been assembled together.
Figure 11:
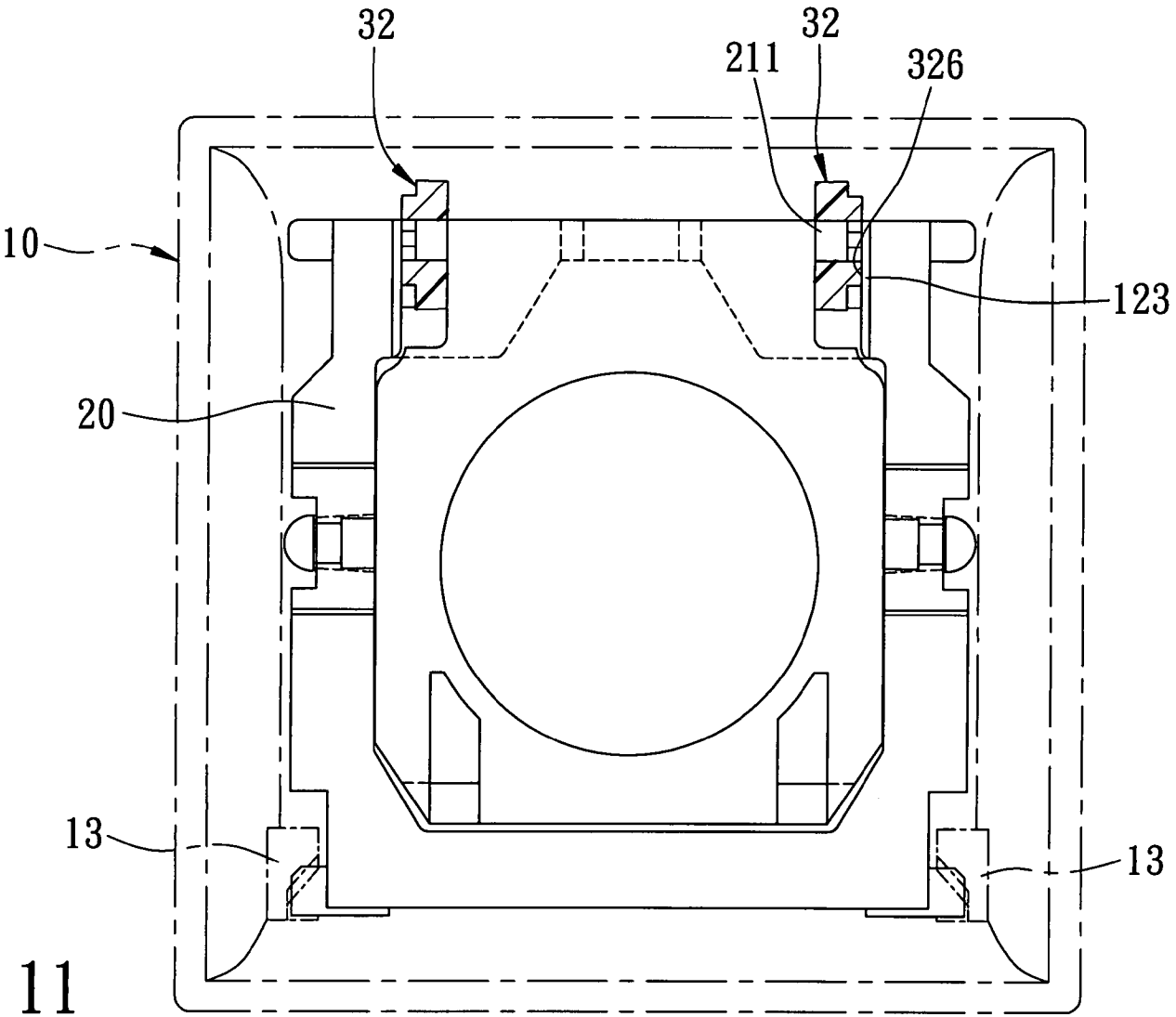
FIG. 11 is a sectional view taken along line 11—11 of FIG. 10.

Referring to FIGS. 10 and 11 in combination with FIG. 3, the first bottom member 12 of the first frame 10 has two spaced apart inclined surfaces 123 and an indentation 122 between the inclined surfaces 123. When the cap support 200 is in the collapsed state, the second top member 21 and the pivot pins 211 are received in the indentation 122. Each inclined surface 123 faces the corresponding pivot pin 211. The key cap 300 is assembled with the cap support 100 when the cap support 100 is in the collapsed state.

In assembly, the pivot pins 211 of the second top member 21 are pressed into the respective pivot holes 322 of the pivot retainers 32, and the latch pins 111 of the first top member 11 are pushed into the respective latch retainers 33. The pivot pins 211 are respectively inserted into the pivot holes 322 through the open distal ends 325 of the pivot retainers 32 along an insertion direction (A) (see FIG. 10). As the pivot pins 211 are pressed into the respective pivot holes 322, the inclined surfaces 123 of the second top member 12 are slid along and guided by the guide surfaces 326 of the guide ribs 323 so that the cap support 100 is properly aligned with the key cap 300 to be quickly and correctly assembled with the key cap 300. Note that each of the guide surfaces 326 and the inclined surfaces 123 is inclined with respect to a line (B) parallel to the insertion direction (A) and that the inclining angles of the guide surfaces 326 and the inclined surfaces 123 with respect to the line (B) are substantially the same.

Due to the presence of the guide surfaces 326 of the guide ribs 323 and the inclined surfaces 123 of the first lateral members 13, the cap support 100 can be automatically guided toward and aligned with the key cap 300, thereby facilitating assembly of the cap support 100 and the key cap 300. Since the guide ribs 323 are relatively small, the entire area, volume and weight of the key cap 300 are reduced, thus fulfilling the requirements for the miniaturization of the key cap 300.

In addition, since the guide ribs 323 are relatively small compared to the guide members 504 of the prior art, the problems resulting from shrinkage upon cooling can be alleviated, thereby facilitating the manufacture of the key cap 300 and decreasing the quantity of defective products during the manufacture of the key cap 300.

Furthermore, because of the provision of the guide ribs 323 on the pivot retainers 32, the connecting area between each pivot retainer 32 and the top wall 31 is increased, thus reinforcing the connection between each pivot retainer 32 and the top wall 31 to enhance the drawability of the key cap 300.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A key switch device comprising a base, a key cap, and a cap support mounted on said base and supporting said key cap, said cap support including:

a first frame having a first top member connected to said key cap, a first bottom member connected to said base, a pair of spaced apart first lateral members interconnecting said first top and bottom members, and a pair of through holes respectively formed in said first lateral members; and a second frame connected pivotally to said first frame and having a second top member connected to said key cap, a second bottom member connected to said base, a pair of spaced apart second lateral members interconnecting said second top and bottom members, and a pair of retaining pins projecting outwardly and respectively from said second lateral members, each of said retaining pins having an outermost head, an inner neck part and a shoulder formed between said outermost head and said inner neck part, said retaining pins being respectively inserted into said through holes until said outermost heads of said retaining pins project outwardly and respectively from said through holes and until said shoulders of said retaining pins extend out respectively from said through holes, wherein each of said through holes is tapered from an inner side to an outer side of a corresponding one of said first lateral members.

2. The key switch device as claimed in claim 1, wherein said outermost head has a substantially hemi-spherical shape.

* * * * *